US008303331B2

(12) United States Patent
Yu et al.

(10) Patent No.: US 8,303,331 B2
(45) Date of Patent: Nov. 6, 2012

(54) POWER RECEPTACLE, POWER PLUG AND POWER CONNECTOR ASSEMBLY WITH IMPROVED HEAT DISSIPATION PATH

(75) Inventors: Wang-I Yu, Jhonghe (TW); Chu-Yi Chiu, Jhonghe (TW); Hung-Chi Tai, Jhonghe (TW)

(73) Assignee: Alltop Electronics (Suzhou) Co., Ltd, Taicang, Jiangsu Province (CN)

( * ) Notice: Subject to any disclaimer, the term of this patent is extended or adjusted under 35 U.S.C. 154(b) by 198 days.

(21) Appl. No.: 12/912,435

(22) Filed: Oct. 26, 2010

(65) Prior Publication Data

US 2011/0287658 A1 Nov. 24, 2011

(30) Foreign Application Priority Data

May 24, 2010 (CN) ..... 2010 1 0180662

(51) Int. Cl.
*H01R 13/00* (2006.01)

(52) U.S. Cl. ..... 439/485; 439/206

(58) Field of Classification Search ..... 439/485, 439/206

See application file for complete search history.

(56) References Cited

U.S. PATENT DOCUMENTS 4,417,777 A * 11/1983 Bamford ..... 439/70
5,336,117 A * 8/1994 Mizuguchi et al. ..... 439/717
6,095,862 A * 8/2000 Doye et al. ..... 439/607.11
6,514,103 B2 * 2/2003 Pape et al. ..... 439/607.01
6,994,598 B2 2/2006 Holmes et al.
7,059,919 B2 6/2006 Clark et al.
7,065,871 B2 * 6/2006 Minich et al. ..... 29/882
7,168,963 B2 * 1/2007 Minich et al. ..... 439/79
7,182,642 B2 * 2/2007 Ngo et al. ..... 439/607.35
7,275,966 B2 * 10/2007 Poh et al. ..... 439/636
7,402,064 B2 * 7/2008 Daily et al. ..... 439/290
7,458,839 B2 * 12/2008 Ngo et al. ..... 439/291
7,597,573 B2 * 10/2009 Defibaugh et al. ..... 439/206
7,637,777 B1 * 12/2009 Trout et al. ..... 439/607.1
7,726,982 B2 * 6/2010 Ngo ..... 439/79
7,749,009 B2 * 7/2010 Minich ..... 439/206
7,857,656 B2 * 12/2010 Tai et al. ..... 439/485
7,914,305 B2 * 3/2011 Amleshi et al. ..... 439/101
8,038,466 B1 * 10/2011 Tai et al. ..... 439/485
8,177,579 B2 * 5/2012 Tai et al. ..... 439/485

* cited by examiner

*Primary Examiner* — Neil Abrams
(74) *Attorney, Agent, or Firm* — Sughrue Mion, PLLC

(57) ABSTRACT

A power connector assembly includes mateable power receptacle and power plug. The power receptacle includes a first insulative housing defining a first heat dissipation path extending through opposite first mating and mounting surfaces, and a receptacle power contact exposed to the first heat dissipation path. The power plug includes a second insulative housing defining a second heat dissipation path extending through a second mounting surface of the second insulative housing, and a plug power contact for abutting against the receptacle power contact. The first and the second heat dissipation paths are in communication with each other and are exposed to an exterior so that heat generated by the receptacle power contact and the plug power contact can be dissipated therethrough.

20 Claims, 9 Drawing Sheets

POWER RECEPTACLE, POWER PLUG AND POWER CONNECTOR ASSEMBLY WITH IMPROVED HEAT DISSIPATION PATH

BACKGROUND OF THE INVENTION

1. Field of the Invention

The present invention relates to a power receptacle, a power plug and a power connector assembly thereof, and more particularly to a power receptacle, a power plug and a power connector assembly thereof with improved heat dissipation path exposed to the exterior through a mounting surface thereof.

2. Description of Related Art

Mateable power receptacle and power plug are commonly used for power transmission. It is known that heat is generated by impedance of power contacts during power transmission. Nowadays, more and more electronic devices need heavy power to work, and power connector assemblies which can endure high current are accordingly needed. Heat dissipation becomes one of the most annoying problems in connector design. If the heat is limited in insulative housings of the power connector assembly, and can not be eliminated timely, the insulative housings might be burnt. Besides, mateable contact portions of contacts of the power connector assembly might melt. The high temperature once monitored by the client-side will crash the electronic devices. Bad heat dissipation may result in security problems for the worse.

U.S. Pat. No. 6,994,598 B2 issued to Holmes et al. on Feb. 7, 2006 discloses a traditional power connector assembly. The power connector assembly includes a male connector and a female connector both provided with multiple power contacts retained in an insulative housing. However, such power contacts are closed in the insulative housings when the male connector and the female connector are mated with each other for power transmission. As a result, heat dissipation thereof is poor.

Hence, a power receptacle, a power plug and a power connector assembly thereof with improved heat dissipation path are needed to solve the above problem.

BRIEF SUMMARY OF THE INVENTION

The present invention provides a power connector assembly including a power receptacle and a power plug for mating with the power receptacle. The power receptacle includes a first insulative housing and a receptacle power contact retained in the first insulative housing. The first insulative housing comprises a first mating surface, a first mounting surface opposite to the first mating surface, and a first passageway extending through the first mating surface and the first mounting surface along a first direction. The receptacle power contact comprises a first contact portion received in the passageway and a first mounting portion connecting with the first contact portion. The power plug comprises a second insulative housing and a second power contact fixed in the second insulative housing. The second insulative housing comprises a top wall, a bottom wall, a second mating surface, a second mounting surface opposite to the second mating surface, and a receiving chamber recessed from the second mating surface for accommodating the power receptacle. The receiving chamber is disposed between the top wall and the bottom wall. The plug power contact comprises a second contact portion protruding into the receiving chamber for abutting against the first contact portion, and a second mounting portion connecting with the second contact portion. A first heat dissipation path is defined in communication with the passageway and further extends through the first mounting surface. A second heat dissipation path is defined in an inner side of at least one of the top wall and the bottom wall of the second insulative housing. The second heat dissipation path is in communication with the receiving chamber and further extends through the second mounting surface. The first and the second heat dissipation paths are in communication with each other and are exposed to an exterior so that heat generated by the receptacle power contact and the plug power contact can be dissipated therethrough.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
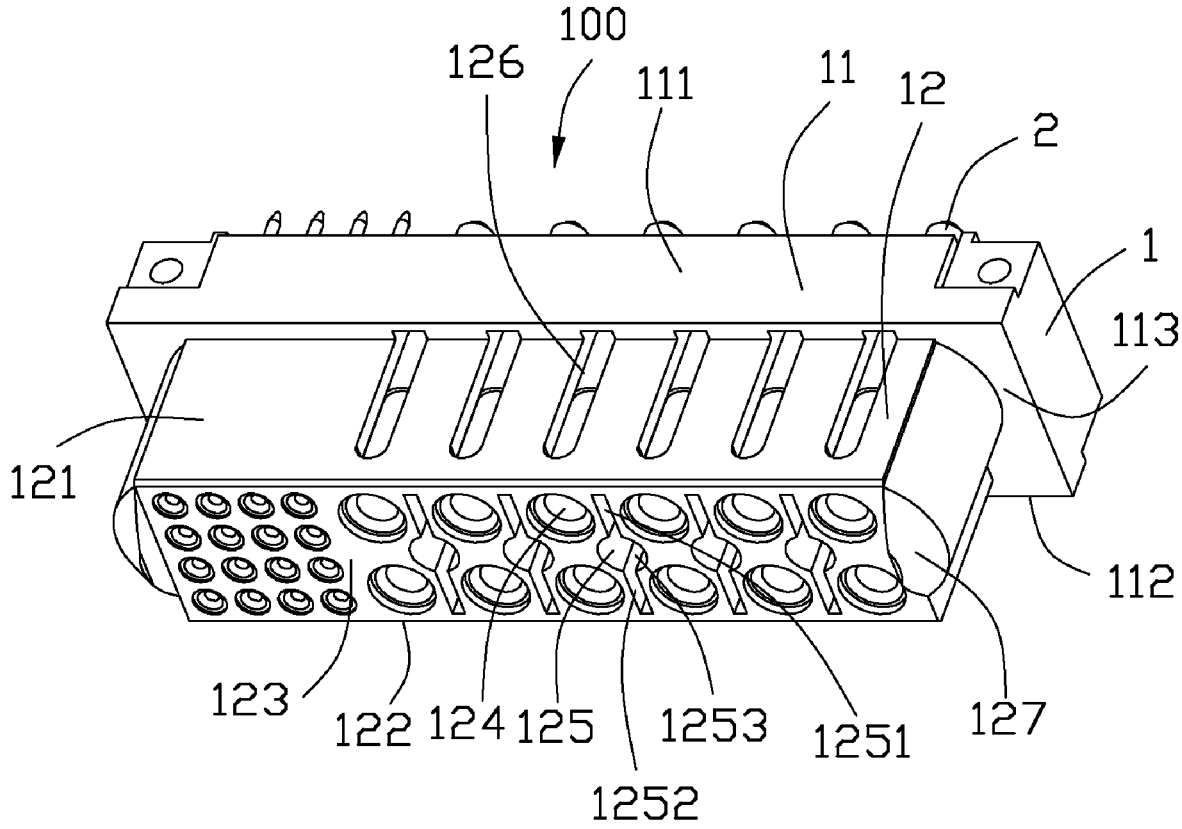
FIG. 1 is a perspective view of a power receptacle in accordance with an embodiment of the present invention.

Reference will now be made to the drawing figures to describe the embodiments of the present invention in detail. In the following description, the same drawing reference numerals are used for the same elements in different drawings.

Figure 2:
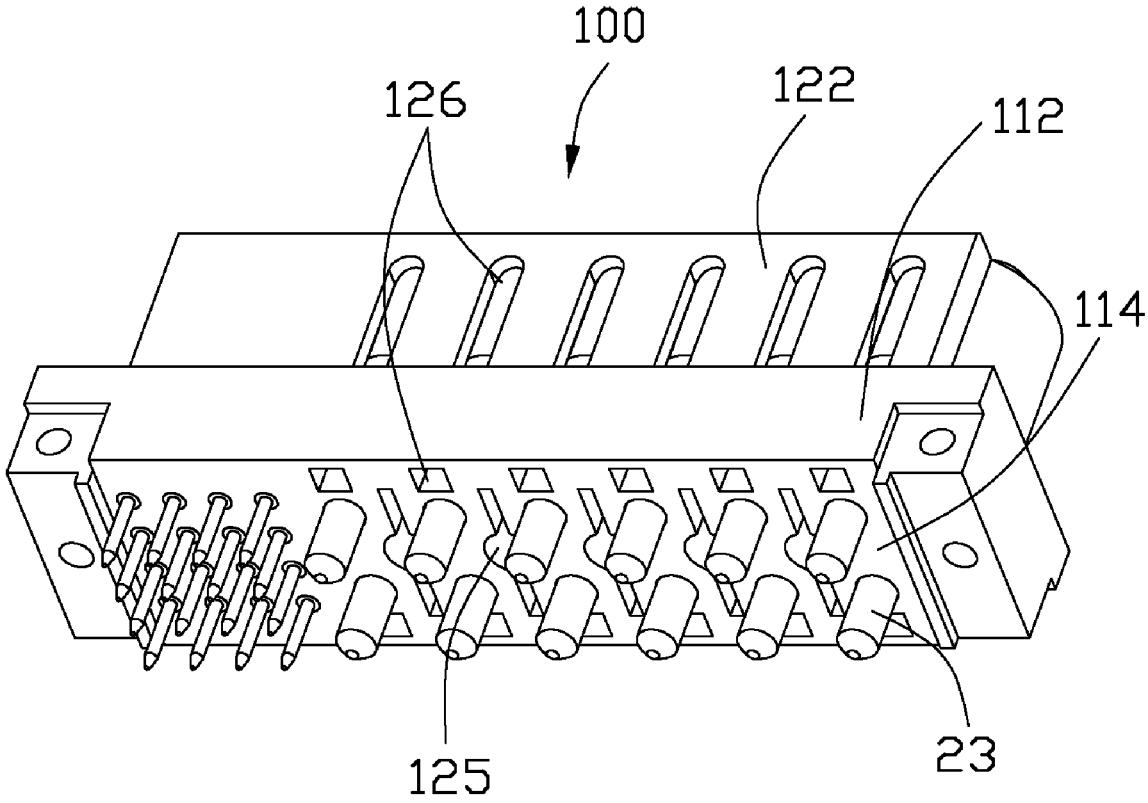
FIG. 2 is a perspective view of the power receptacle similar to FIG. 1, but taken from another aspect.

Please refer to FIGS. 1 and 2, the power receptacle 100 includes a receptacle insulative housing 1 and a plurality of receptacle power contacts 2 fixed to the insulative housing 1. The power contacts 2 are arranged in two lines parallel to a longitudinal direction. The insulative housing 1 includes a base 11 and a mating portion 12 protruding from a front surface 113 of the base 11 along a first direction perpendicular to the longitudinal direction. The base 11 includes a top wall 111, a bottom wall 112 and a first mounting surface 114 opposite to the front surface 113. The mating portion 12 is contractive with respect to the base 11 and includes an upper surface 121, a lower surface 122 and a first mating surface

123. The first mating surface 123 is parallel to the first mounting surface 114 and is perpendicular to both the upper surface 121 and the lower surface 122. The top wall 111 and the bottom wall 112 are located outside of the upper surface 121 and the lower surface 122 along a vertical direction, respectively. A plurality of passageways 124 are defined through the first mating surface 123 and the first mounting surface 114 of the insulative housing 1 along the first direction for receiving the power contacts 2. Besides, a plurality of first through holes 125 are defined through the first mating surface 123 and the first mounting surface 114 of the insulative housing 1 along the first direction as well. The first through holes 125 are parallel to the passageways 124, and are aligned with each other along the longitudinal direction perpendicular to both the first direction and the vertical direction as best shown in FIG. 1. The first through holes 125 are parallel to the passageways 124. Each first through hole 125 is disposed between and in communication with the adjacent passageways 124.

Referring to FIGS. 1 and 2, according to the preferred embodiment of the present invention, both the upper surface 121 and the lower surface 122 define a plurality of first slots 126 in communication with the corresponding passageways 124. Alternatively, the first slots 126 can be selectively formed on the upper surface 121 and the lower surface 122. Each first slot 126 extends through the first mounting surface 114 along the first direction to be exposed to an exterior. As shown in FIGS. 1 and 2, each first slot 126 is exposed to the exterior as well along the vertical direction perpendicular to the first direction. The first slots 126, the passageways 124 and the first through holes 125 are in communication with each other to jointly form a first heat dissipation path. Each first slot 126 is further recessed into the base 11 along the vertical direction in order to enlarge the first heat dissipation path. The first slots 126 formed in the upper surface 121 are aligned with the corresponding first slots 126 formed in the lower surface 122 along the vertical direction.

As shown in FIG. 1, the first slots 126 do not extend through the first mating surface 123 in order to ensure the intensity of the insulative housing 1 for assembling the power contacts 2. Each first through hole 125 is not provided for receiving the power contacts 2 but for heat dissipation of the power contacts 2. The first through holes 125 are spaced a distance from the passageways 124 when viewed from the first mating surface 123. Each first through hole 125 includes an upper slit 1251, a lower slit 1252 aligned with the upper slit along the vertical direction, and a widened round opening 1253 in communication with the upper slit 1251 and the lower slit 1252. The mating portion 12 further includes a pair of guiding posts 127 with arced outer surfaces for guiding insertion into the power plug 200.

Figure 7:
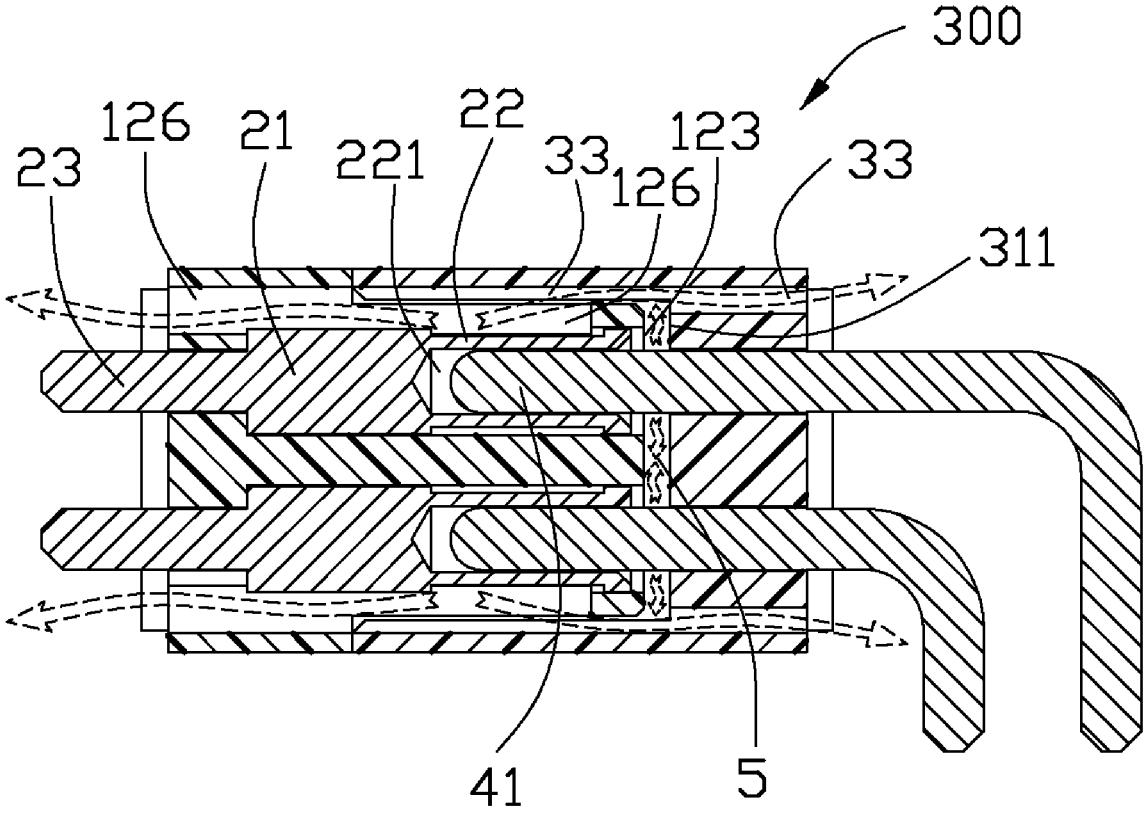
FIG. 7 is a cross-sectional view of the power connector assembly taken along line 7-7 of FIG. 5.

As shown in FIG. 7, each power contact 2 includes a retaining portion 21 fixed in the base 11, a first contact portion 22 extending forwardly from the retaining portion 21, and a first mounting portion 23 extending backwardly from the retaining portion 21. Each first contact portion 22 is center hollow to form a receiving opening 221. The first contact portions 22 are embedded in the passageways 124 so as not to extend beyond the first mating surface 123. The first mounting portions 23 are cylinder shaped and extend beyond the first mounting surface 114.

Figure 3:
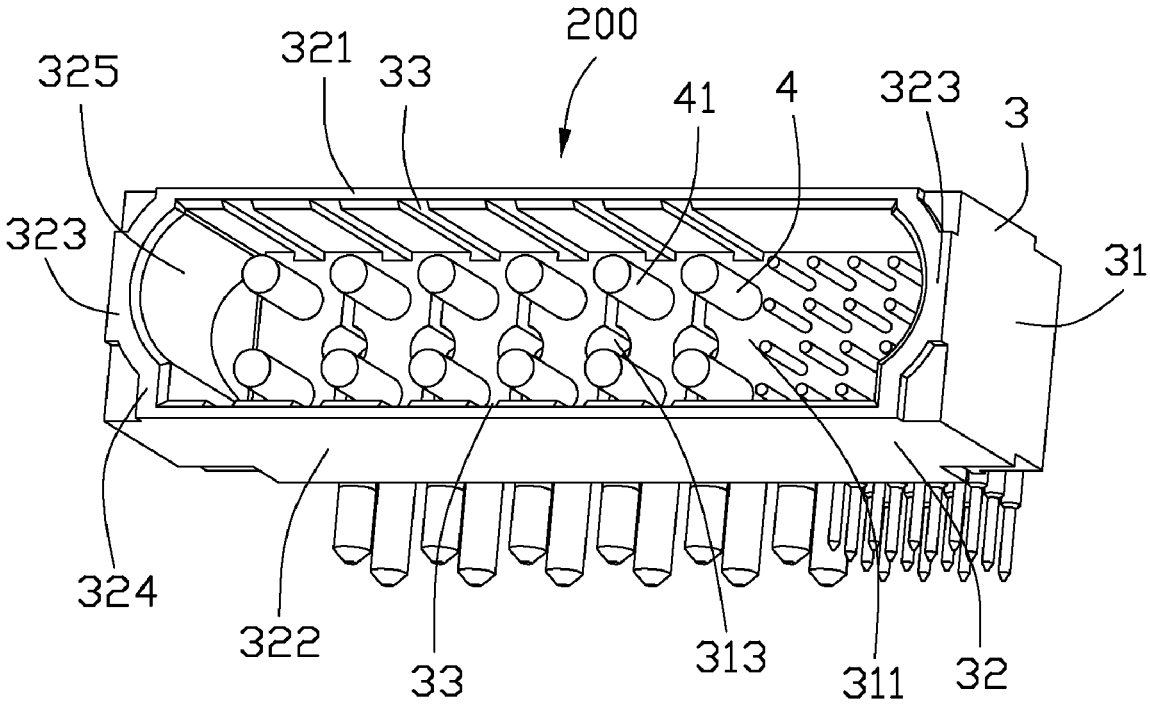
FIG. 3 is a perspective view of a power plug in accordance with an embodiment of the present invention.
Figure 4:
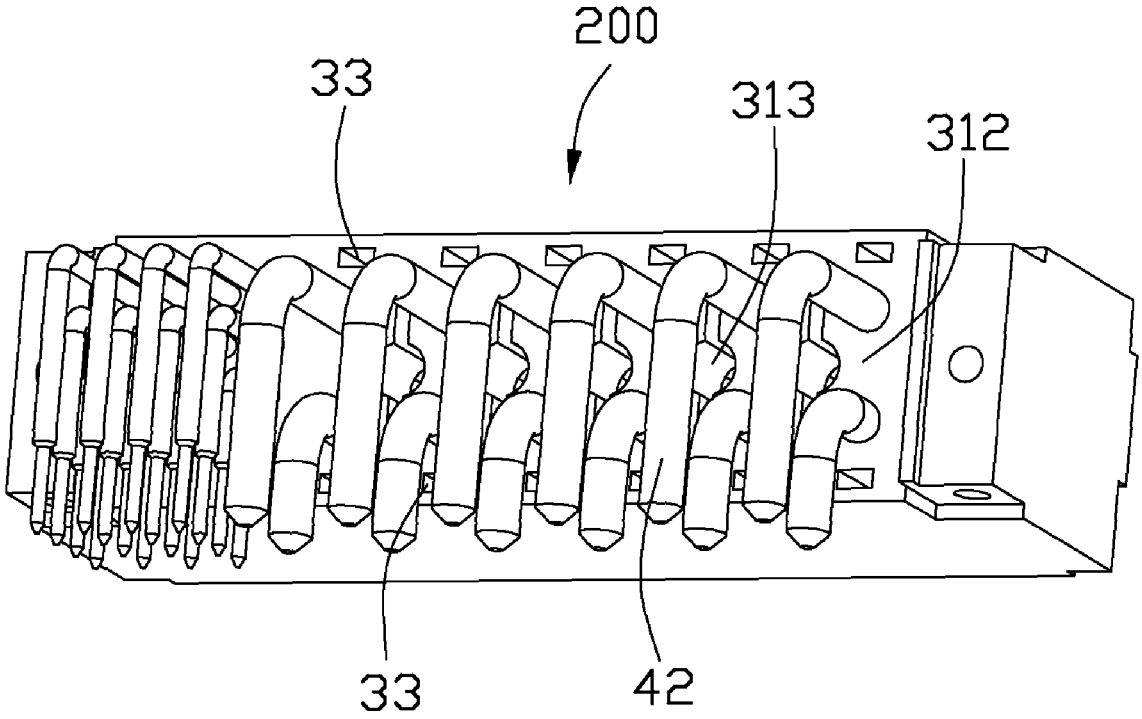
FIG. 4 is a perspective view of the power plug similar to FIG. 3, but taken from another aspect.
Figure 5:
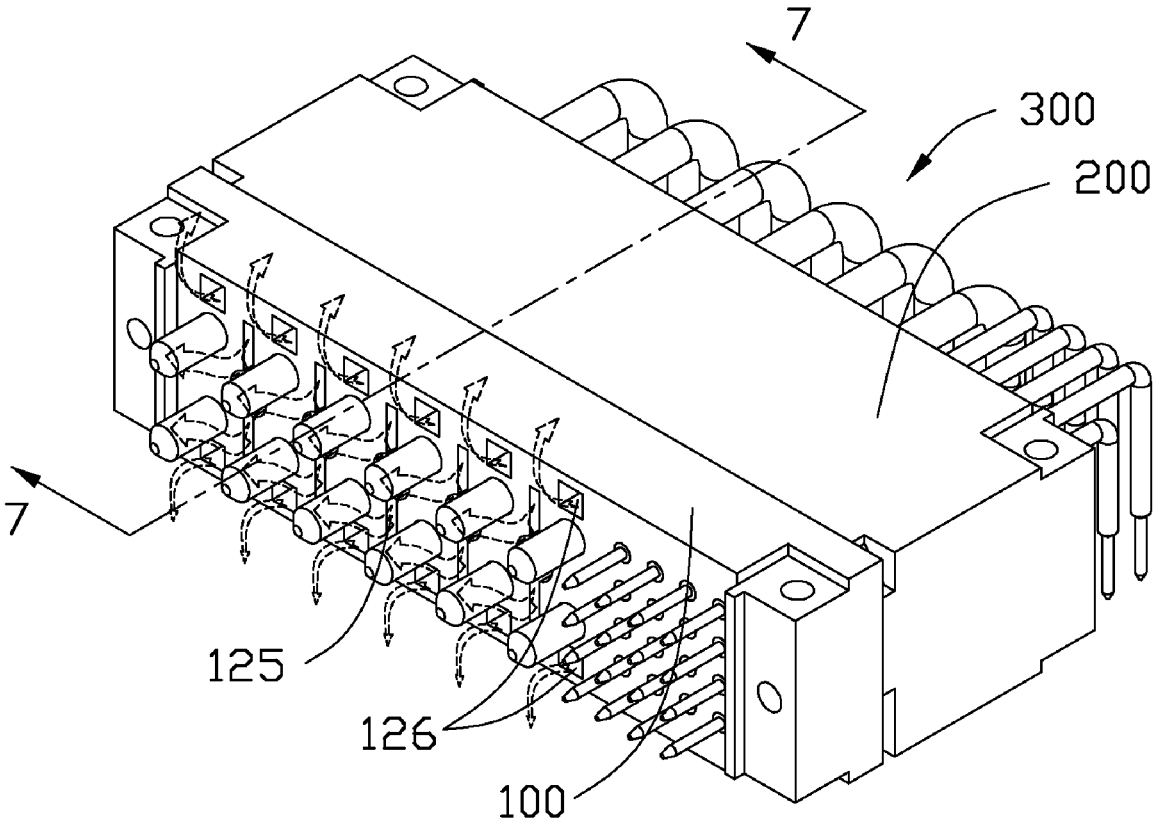
FIG. 5 is a perspective view of a power connector assembly with the power plug and the power receptacle mated with each other in accordance with an embodiment of the present invention.
Figure 6:
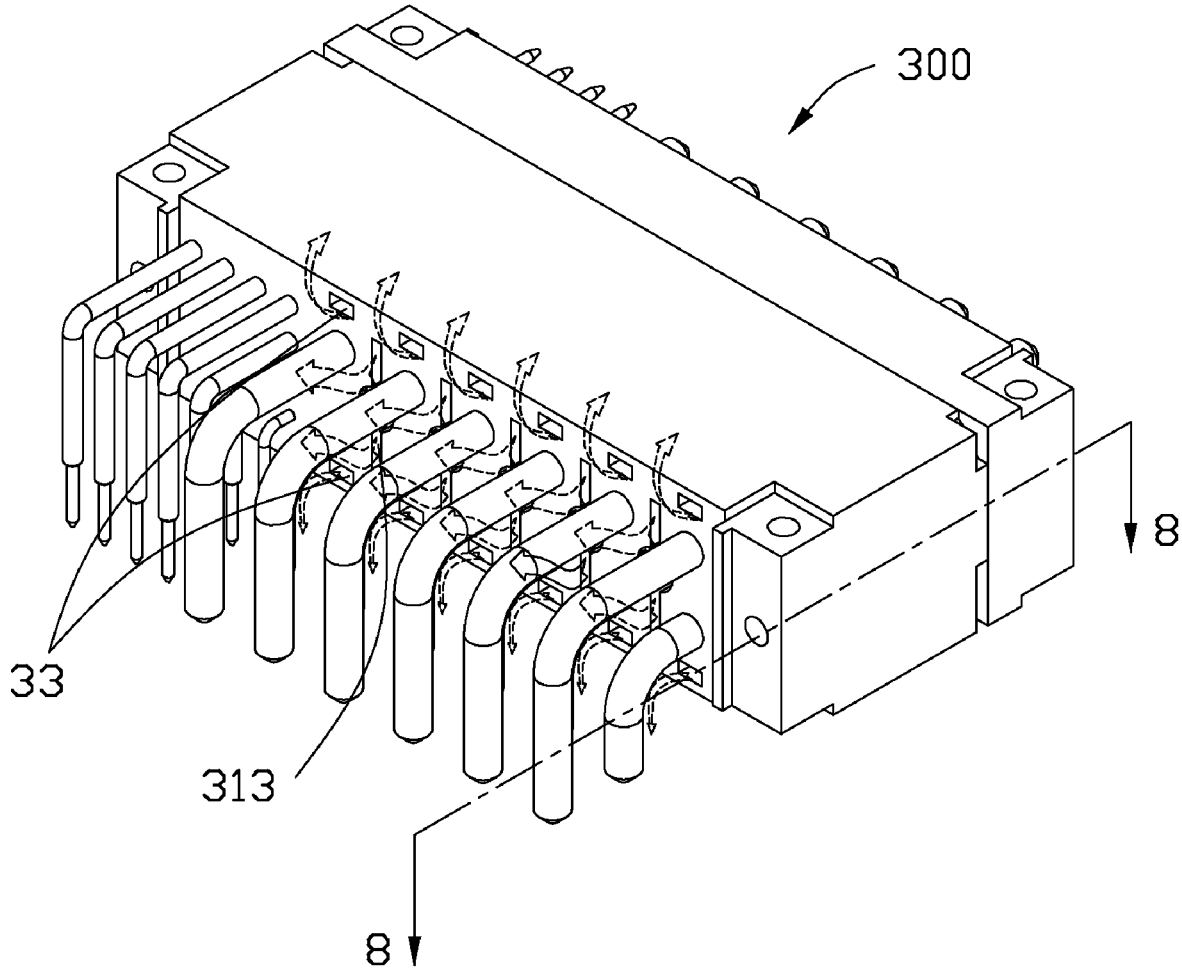
FIG. 6 is a perspective view of the power connector assembly similar to FIG. 5, but taken from another aspect.

As shown in FIGS. 3 and 4, the power plug 200 includes a plug insulative housing 3 and a plurality of plug power contacts 4 fixed to the insulative housing 3. The insulative housing 3 includes a base portion 31 and a mating portion 32 protruding from the base portion 31 along the first direction. The mating portion 32 includes a top wall 321, a bottom wall 322, a pair of side walls 323 connecting the top wall 321 and the bottom wall 322, a second mating surface 324 perpendicular to the top wall 321 and the bottom wall 322, and a receiving chamber 325 recessed from the second mating surface 324. The base portion 31 includes a front surface 311 exposed to the receiving chamber 325, a second mounting surface 312 opposite to the front surface 311, and a plurality of second through holes 313 extending through the front surface 311 and the second mounting surface 312. Each second through hole 313 is of the same configuration of the first through hole 125 and is aligned with the corresponding first through hole 125 along the first direction.

Referring to FIGS. 3 and 4, according to the embodiment of the present invention, inner sides of both the top wall 321 and the bottom wall 322 define a plurality of second slots 33 in communication with the receiving chamber 325. Alternatively, the second slots 33 can be selectively formed on the inner side of the top wall 321 and the bottom wall 322. Each second slot 33 linearly extend through the second mating surface 324 and further linearly extend through the second mounting surface 312 to be exposed to the exterior. The second slots 33 together with the receiving chamber 325 form a second heat dissipation path. Besides, the second slots 33 are further recessed into the base portion 31 along the vertical direction in order to enlarge the second heat dissipation path.

As shown in FIGS. 3 and 4, each plug power contact 4 includes a cylinder shaped second contact portion 41 extending into the receiving chamber 325, and a second mounting portion 42 connecting with the second contact portion 41 and further extending through the second mounting surface 312.

Figure 8:
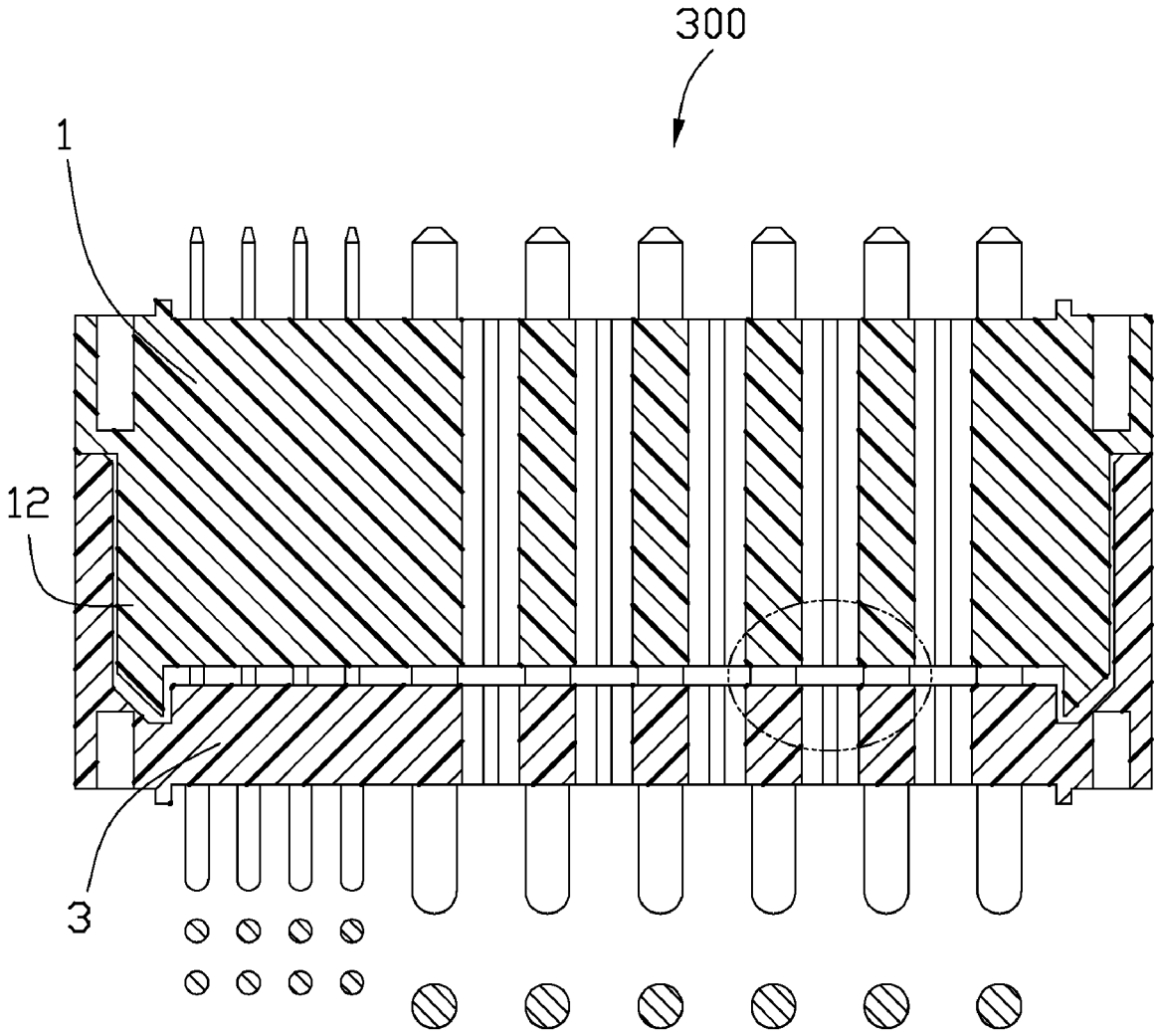
FIG. 8 is a cross-sectional view of the power connector assembly taken along line 8-8 of FIG. 6.
Figure 9:
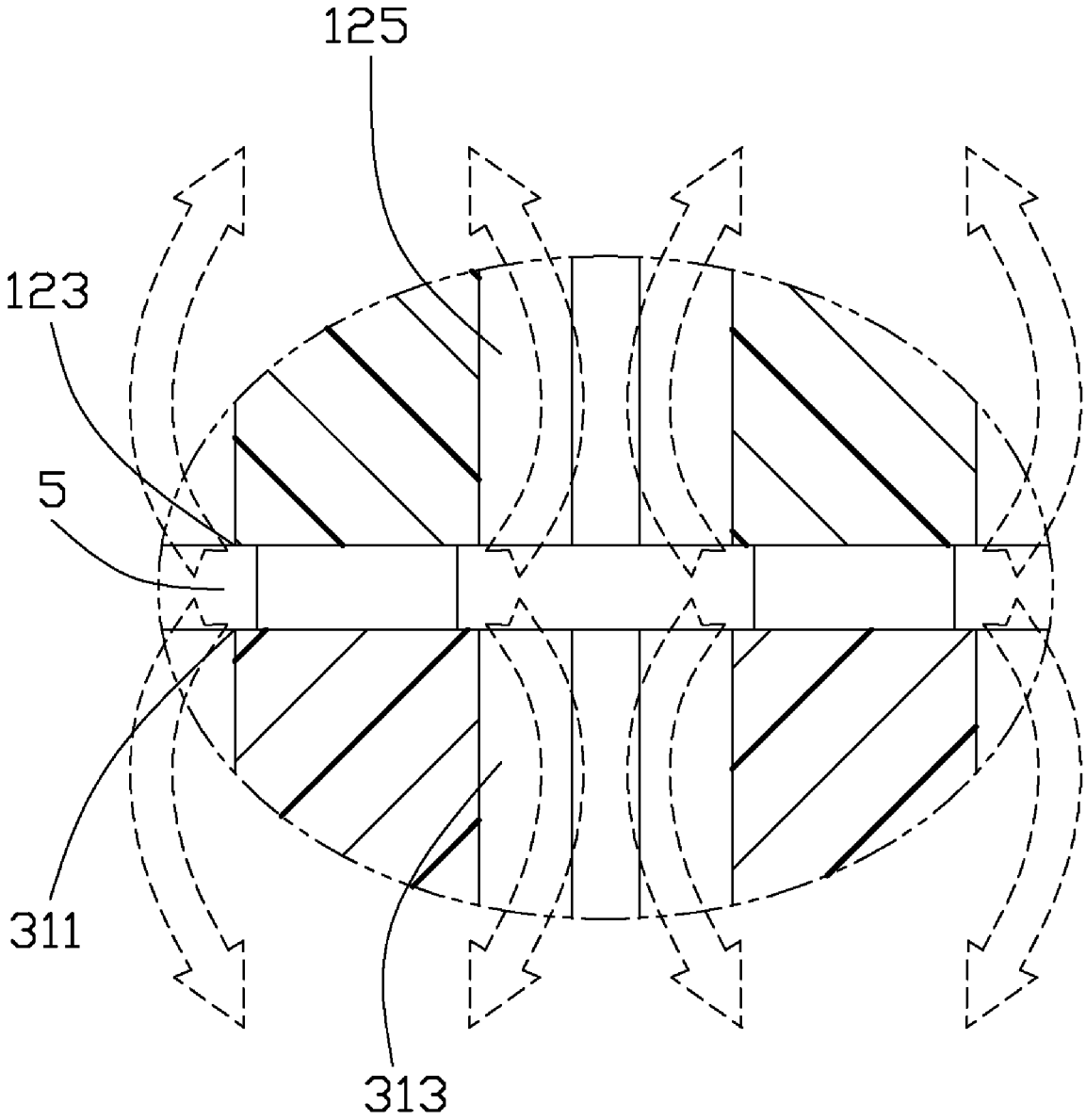
FIG. 9 is a partial enlarged view of a circle portion of FIG. 8.

As shown in FIGS. 5 to 8, when the power receptacle 100 is fully received in the receiving chamber 325 of the power plug 200, each second contact portion 41 is inserted into the receiving opening 221 of the first contact portion 22. Since most heat generated by the power receptacle contacts 2 and the plug power contacts 4 occurs nearby the first and the second contact portions 22, 41, the heat can be dissipated via the first and the second slots 126, 33 which are exposed to the exterior through the first and the second mounting surfaces 114, 312 along the first direction. Besides, the heat can also be dissipated to the exterior via the first slots 126 along the vertical direction. As shown in FIG. 7, the first mating surface 123 of the power receptacle 100 is spaced a distance from the front surface 311 of the power plug 200 in order to form an inner heat dissipation channel 5 which is in communication with the first and the second heat dissipation paths. As shown in FIG. 7, within a length of the receiving chamber 325 along the first direction, the second heat dissipation path is located over the first heat dissipation path. As shown in FIGS. 8 and 9, under this arrangement, robust airflow occurs through the inner heat dissipation channel 5 to expedite heat dissipation. Moreover, the first through holes 125 are aligned and in communication with the second through holes 313 along the first direction for heat dissipation as well. As a result, both the receptacle insulative housing 1 and the plug insulative housing 3 can be prevented from being burnt and unrecoverable high deformation, as well as the power receptacle contacts 2 and the plug power contacts 4.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power receptacle comprising:

an insulative housing comprising a base and a mating portion protruding from the base along a first direction, the mating portion defining a first mating surface for mating with a complementary connector, the base comprising a first mounting surface opposite to the first mating surface, at least one passageway being defined in the insulative housing and extending through the first mating surface and the first mounting surface along the first direction; and at least one receptacle power contact comprising a first contact portion received in the passageway and a first mounting portion connecting with the first contact portion; wherein a slot is defined through at least one of an upper surface and a lower surface of the mating portion, the slot being exposed to an exterior and further extending through the first mounting surface, the slot being in communication with the passageway in order to form a heat dissipation path for eliminating heat generated by the receptacle power contact.

2. The power receptacle as claimed in claim 1, wherein the slot is exposed to the exterior both along the first direction and a second direction substantially perpendicular to the first direction.

3. The power receptacle as claimed in claim 2, wherein the first mating surface is parallel to the first mounting surface beyond which the first mounting portion extends.

4. The power receptacle as claimed in claim 2, wherein the mating portion is contractive with respect to the base, and the slot is further recessed into the base along the second direction in order to enlarge the slot.

5. The power receptacle as claimed in claim 2, wherein both the upper surface and the lower surface of the mating portion define the slot; and wherein the slot defined in the upper surface is aligned with the slot defined in the lower surface along the second direction.

6. The power receptacle as claimed in claim 2, wherein the insulative housing defines a through hole extending through the first mating surface and the first mounting surface, and the through hole is arranged adjacent to and in communication with the passageway in order to jointly form the heat dissipation path.

7. The power receptacle as claimed in claim 6, wherein the through hole is arranged between adjacent passageways which are aligned along a third direction perpendicular to the first direction and the second direction, the through hole being in communication with the adjacent passageways.

8. The power receptacle as claimed in claim 6, wherein the through hole is not provided for receiving the receptacle power contact but for heat dissipation, the through hole and the passageway being separated from each other when viewed from the first mating surface.

9. The power receptacle as claimed in claim 8, wherein the through hole comprises an upper slit, a lower slit aligned with the upper slit, and a widened round opening in communication with the upper slit and the lower slit.

10. A power plug comprising:

an insulative housing comprising a base portion and a mating portion protruding from the base portion along a first direction, the mating portion comprising a top wall, a bottom wall, a second mating surface and a receiving chamber recessed from the second mating surface for accommodating a complementary connector, the receiving chamber being disposed between the top wall and the bottom wall, the base portion comprising a second mounting surface opposite to the second mating surface; and at least one plug power contact fixed to the insulative housing and comprising a second contact portion protruding into the receiving chamber and a second mounting portion connecting with the second contact portion; wherein a slot is formed in an inner side of at least one of the top wall and the bottom wall of the mating portion, the slot being exposed to the receiving chamber and further extending through the second mounting surface in order to form a heat dissipation path for eliminating heat generated by the plug power contact.

11. The power plug as claimed in claim 10, wherein the slot is further recessed into the base portion along a second direction perpendicular to the first direction in order to enlarge the slot.

12. The power plug as claimed in claim 10, wherein both the top wall and the bottom wall of the mating portion define the slot; and wherein the slot defined in the top wall is aligned with the slot defined in the bottom wall.

13. The power plug as claimed in claim 10, wherein the second contact portion is cylinder shaped with the second mounting portion extending through the second mounting surface, and the slot extends through the second mating surface of the mating portion.

14. The power plug as claimed in claim 10, wherein the base portion comprises a front surface exposed to the receiving chamber, and a through hole extending through the front surface and the second mounting surface, the through hole being arranged adjacent to the plug power contact and in communication with the receiving chamber in order to jointly form the heat dissipation path.

15. The power plug as claimed in claim 14, wherein the through hole is not provided for receiving the plug power contact but for heat dissipation, the through hole comprising an upper slit, a lower slit aligned with the upper slit, and a widened round opening in communication with the upper slit and the lower slit.

16. A power connector assembly comprising:

a power receptacle comprising:

a first insulative housing comprising a first mating surface, a first mounting surface opposite to the first mating surface, and a first passageway extending through the first mating surface and the first mounting surface along a first direction; and a receptacle power contact comprising a first contact portion received in the passageway and a first mounting portion connecting with the first contact portion; and a power plug comprising:

a second insulative housing comprising a top wall, a bottom wall, a second mating surface, a second mounting surface opposite to the second mating surface, and a receiving chamber recessed from the second mating surface for accommodating the power receptacle, the receiving chamber being disposed between the top wall and the bottom wall; and a plug power contact fixed to the second insulative housing and comprising a second contact portion protruding into the receiving chamber for abutting against the first contact portion, and a second mounting portion connecting with the second contact portion; wherein a first heat dissipation path is defined in communication with the passageway and further extends through the first mounting surface; and wherein a second heat dissipation path is defined in an inner side of at least one of the top wall and the bottom wall of the second insulative housing, the second heat dissipation path being in communication with the receiving chamber and further extending through the second mounting surface; and wherein the first and the second heat dissipation paths are in communication with each other and are exposed to an exterior so that heat generated by the receptacle power contact and the plug power contact can be dissipated therethrough.

17. The power connector assembly as claimed in claim 16, wherein the first contact portion is center hollow, and the second contact portion is cylinder shaped to be received in the first contact portion, the first mounting portion and the second mounting portion extending beyond the first mounting surface and the second mounting surface, respectively.

18. The power connector assembly as claimed in claim 16, wherein the second heat dissipation path is located over the first heat dissipation path within a length of the receiving chamber along the first direction; wherein the first and the second heat dissipation paths are exposed to the exterior along the first direction, and the first heat dissipation path extends through the first insulative housing to be exposed to the exterior along a second direction perpendicular to the first direction.

19. The power connector assembly as claimed in claim 16, wherein the first insulative housing defines a first through hole extending through the first mating surface and the first mounting surface, and the first through hole is arranged adjacent to and in communication with the first heat dissipation path; and wherein the second insulative housing comprises a front surface exposed to the receiving chamber, and a second through hole extending through the front surface and the second mounting surface, the second through hole being in communication with the second heat dissipation path, the first through hole and the second through hole being aligned with each other along the first direction.

20. The power connector assembly as claimed in claim 16, wherein the second insulative housing comprises a front surface exposed to the receiving chamber, the second contact portion protruding from the front surface; when the first insulative housing is fully inserted in the receiving chamber of the second insulative housing, the first mating surface and the front surface are spaced a distance from each other in order to form an inner heat dissipation channel which is in communication with the first and the second heat dissipation paths.

* * * * *